US007499661B2

(12) United States Patent
Ikeda

(10) Patent No.: US 7,499,661 B2
(45) Date of Patent: Mar. 3, 2009

(54) IMAGE PRINTING APPARATUS FOR PERFORMING JOB BASED PRINTING IN WHICH AN INTERRUPT JOB IS STORED AS A JOB IN ACCORDANCE WITH A PRIORITY LEVEL

(75) Inventor: Takemasa Ikeda, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 413 days.

(21) Appl. No.: 11/287,778

(22) Filed: Nov. 28, 2005

(65) Prior Publication Data

US 2006/0188284 A1 Aug. 24, 2006

(30) Foreign Application Priority Data

Feb. 21, 2005 (JP) ..... 2005-043793
Feb. 21, 2005 (JP) ..... 2005-043800

(51) Int. Cl.
*G03G 15/00* (2006.01)

(52) U.S. Cl. ..... 399/87

(58) Field of Classification Search ..... 399/87
See application file for complete search history.

(56) References Cited

U.S. PATENT DOCUMENTS 6,341,907 B1 * 1/2002 Katsuyoshi ..... 400/582
2002/0012135 A1 * 1/2002 Nagaso ..... 358/400

FOREIGN PATENT DOCUMENTS

JP 11-292329 A 10/1999
JP 2001-331064 A 11/2001
JP 2003-228204 A 8/2003
JP 2004-106424 A 4/2004

* cited by examiner

*Primary Examiner*—David M Gray
*Assistant Examiner*—Bryan Ready
(74) *Attorney, Agent, or Firm*—Frishauf, Holtz, Goodman & Chick, P.C.

(57) ABSTRACT

The present invention provides an image printing apparatus comprising: a tray on which printing paper sheets are placed; a job storage section storing a predetermined job and a forthcoming post-determined job; a priority level setting section setting execution priority levels of jobs; and a control unit. When a tray set to be occupied for the predetermined job is the same as that selected for the post-determined job, the control unit allows to store the post-determined job in the job storage section only if the execution priority level set for the post-determined job is lower than that set for the predetermined job.

10 Claims, 9 Drawing Sheets

IMAGE PRINTING APPARATUS FOR PERFORMING JOB BASED PRINTING IN WHICH AN INTERRUPT JOB IS STORED AS A JOB IN ACCORDANCE WITH A PRIORITY LEVEL

CROSS-REFERENCE TO RELATED APPLICATION

This application makes reference to, incorporates the same herein, and claims all benefits accruing under 35 U.S.C. § 119 from an application for IMAGE PRINTING APPARATUS earlier filed in the Japanese Patent Office on Feb. 21, 2005, and there duly assigned No. 043793/2005 and an application for IMAGE PRINTING APPARATUS earlier filed in the Japanese Patent Office on Feb. 21, 2005, and there duly assigned No. 043800/2005.

BACKGROUND OF THE INVENTION

1. Field of the Invention

The present invention relates to an image printing apparatus and, more particularly, to an image printing apparatus which has a tray for placing printing media thereon and prints an image, on the basis of a job, on a printing medium supplied from the tray.

2. Description of the Related Art

In an image printing apparatus having an interrupt function of interrupting execution of a predetermined job and executing another interrupt job and a job management function with which the execution priority levels of jobs stored in a storage section can be changed, when a post-determined job such as an interrupt job or priority level-changed job is executed first, the predetermined job must be complete without any error.

When a given user sets special paper sheets such as coated paper sheets or embossed paper sheets in a tray of an image printing apparatus, he wants to use these paper sheets only for himself. When the image printing apparatus is used by a plurality of users in a network environment, the special paper sheets set in the tray may be used by a post-determined job of another user. The given user wants not to allow another user to use the tray designated by the given user.

To solve the above problems, according to one proposal, in an image printing apparatus having an interrupt function of interrupting execution of a predetermined job and executing another interrupt job, when a tray selected by an interrupt job is the same as that selected by the predetermined job, printing of the interrupt job is inhibited, or the interrupt job is inhibited from selecting the tray selected by the predetermined job. For example, see Japanese Unexamined Patent Publication No. 2001-331064 (patent reference 1). Patent reference 1 also proposes that the tray selected in printing the predetermined job is physically locked and cannot be unloaded.

According to another proposal, when selecting a tray for a post-determined job, selection of a tray already selected by a predetermined job is inhibited. For example, see Japanese Unexamined Patent Publication No. 11-292329 (patent reference 2). The tray selected by the predetermined job will not be selected by the post-determined job. The predetermined job is always printed on the desired paper sheet.

Still another image printing apparatus is proposed in which when a predetermined job which uses a tray designated by a user but does not allow use of this tray by another job is complete, the selection inhibition can be automatically canceled. For example, see Japanese Unexamined Patent Publication No. 2004-106424 (patent reference 3). This makes it possible to prevent a decrease in use efficiency of the tray.

Still another image printing apparatus is proposed in which in job reservation, a sheet set in a manual feed tray is fed by a paper feed section to an apparatus main body. For example, see Japanese Unexamined Patent Publication No. 2003-228204 (patent reference 4). A sheet selected by a given user can be prevented from being changed by the next user. This makes it possible to reliably ensure the priority on sheet selection by the given user.

In patent references 1 to 3, however, the post-determined job which designates the tray coinciding with that of the predetermined job cannot be accepted until the end of the predetermined job. The user of the post-determined job, who wants to use the same tray as that of the predetermined job, must wait for setting a job for selecting the tray occupied for the predetermined job until the end of the predetermined job. This scheme is very poor in working efficiency for the user who sets the post-determined job. This also results in disadvantages from the viewpoint of mental hygiene. While the user who wants to set the post-determined job proceeds another job until the end of the predetermined job, he may forget to set the post-determined job, resulting in a large delay in delivery of printing products. The use efficiency of the tray occupied for the predetermined job often decreases greatly.

In patent reference 1, tray unloading is inhibited after the image printing operation of the predetermined job is complete. However, before the predetermined job is executed, another user may unload the tray and replace the paper sheets with desired paper sheets.

In patent reference 4, a holding device which temporarily holds sheets is required in addition to the tray. The apparatus becomes bulky in producing a large number of printing products.

SUMMARY OF THE INVENTION

First, the present invention can provide an image printing apparatus capable of improving working efficiency such as guarantee of the preferential use right for a tray desired in a predetermined job.

Second, the present invention can also provide an image printing apparatus capable of ensuring the preferential use right for a tray desired in a predetermined job without increasing the size of the apparatus.

In a first aspect of the present invention, there is provided an image printing apparatus for printing an image on a printing medium on the basis of a job, comprising:

a plurality of trays on which printing media are placed;

a job storage section which sequentially stores a plurality of jobs;

a tray selection section which selects a tray on which a printing medium subjected to image printing based on a forthcoming post-determined job is placed;

an occupation setting section which sets to occupy a tray selected by the tray selection section;

a priority level setting section which sets execution priority levels of jobs stored in the job storage section; and a control unit which determines whether the post-determined job is allowed to be stored in the job storage section, wherein when a tray set to be occupied for a predetermined job stored in the job storage section prior to the post-determined job is the same as that selected for the post-determined job, the control unit allows to store the post-determined job in the job storage section only if the execution priority level set for the post-determined job is lower than that set for the predetermined job.

In a second aspect of the present invention, there is provided an image printing apparatus for printing an image on a printing medium on the basis of a job, comprising:

a plurality of trays on which printing media are placed;

a job storage section which sequentially stores a plurality of jobs;

a tray selection section which selects a tray on which a printing medium subjected to image printing based on a forthcoming post-determined job is placed;

an occupation setting section which sets to occupy a tray selected by the tray selection section;

a priority level setting section which sets execution priority levels of jobs stored in the job storage section; and a control unit which determines whether the post-determined job is allowed to be stored in the job storage section, wherein when a tray set to be occupied for a predetermined job stored in the job storage section prior to the post-determined job is the same as that selected for the post-determined job and image printing based on the predetermined job is not complete yet, the control unit allows to store the post-determined job in the job storage section only if the execution priority level set for the post-determined job is lower than that set for the predetermined job.

In a third aspect of the present invention, there is provided an image printing apparatus for printing an image on a printing medium on the basis of a job, comprising:

a plurality of trays on which printing media are placed;

a job storage section which sequentially stores a plurality of jobs;

a tray selection section which selects a tray on which a printing medium subjected to image printing based on a forthcoming post-determined job is placed;

an occupation setting section which sets to occupy a tray selected by the tray selection section;

a priority level setting section which sets execution priority levels of jobs stored in the job storage section; and a control unit which determines whether the post-determined job is allowed to be stored in the job storage section, wherein in case of keeping the following conditions (A) and (B) satisfied, the control unit inhibits to store the post-determined job in the job storage section:

(A) a tray set to be occupied for a predetermined job stored in the job storage section prior to the post-determined job is the same as that selected for the post-determined job; and (B) an execution priority level set for the post-determined job is higher than that set for the predetermined job.

In a fourth aspect of the present invention, there is provided an image printing apparatus for printing an image on a printing medium on the basis of a job, comprising:

a plurality of trays on which printing media are placed;

a job storage section which sequentially stores a plurality of jobs;

a tray selection section which selects a tray on which a printing medium subjected to image printing based on a forthcoming post-determined job is placed;

an occupation setting section which sets to occupy a tray selected by the tray selection section;

a priority level setting section which sets execution priority levels of jobs stored in the job storage section; and a control unit which determines whether the post-determined job is allowed to be stored in the job storage section, wherein in case of keeping the following conditions (A), (B), and (C) satisfied, the control unit inhibits to store the post-determined job in the job storage section:

(A) a tray set to be occupied for a predetermined job stored in the job storage section prior to the post-determined job is the same as that selected for the post-determined job;

(B) an execution priority level set for the post-determined job is higher than that set for the predetermined job; and (C) image printing based on the predetermined job is not complete yet.

In a fifth aspect of the present invention, there is provided an image printing apparatus for printing an image on a printing medium on the basis of a job, comprising:

a plurality of trays on which printing media are placed;

a job storage section which sequentially stores a plurality of jobs;

a tray selection section which selects a tray on which a printing medium subjected to image printing based on a forthcoming post-determined job is placed;

an occupation setting section which sets to occupy a tray selected by the tray selection section; and a priority level setting section which sets execution priority levels of jobs stored in the job storage section, wherein when a tray set to be occupied for a predetermined job stored in the job storage section prior to the post-determined job is the same as that selected for the post-determined job, the priority level setting section sets an execution priority level of the post-determined job lower than that set for the predetermined job.

In a sixth aspect of the present invention, there is provided an image printing apparatus for printing an image on a printing medium on the basis of a job, comprising:

a tray on which a printing medium is placed;

a job storage section which sequentially stores a plurality of jobs;

an occupation setting section which sets to occupy a tray;

an opening and closing inhibition section which inhibits opening and closing of said tray; and a control unit which determines whether said occupation setting section has made the occupation setting, and when the occupation setting is determined to have made the occupation setting, makes said opening and closing inhibition section inhibit closing of said occupied tray until image printing based on the job whose tray is set to be occupied is complete from immediately after storage, in the job storage section, of the job whose tray is set to be occupied.

The present invention is more specifically described in the following paragraphs by reference to the drawings attached only by way of example.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

Several preferred embodiments of the present invention will be described with reference to the accompanying drawings.

Figure 1:
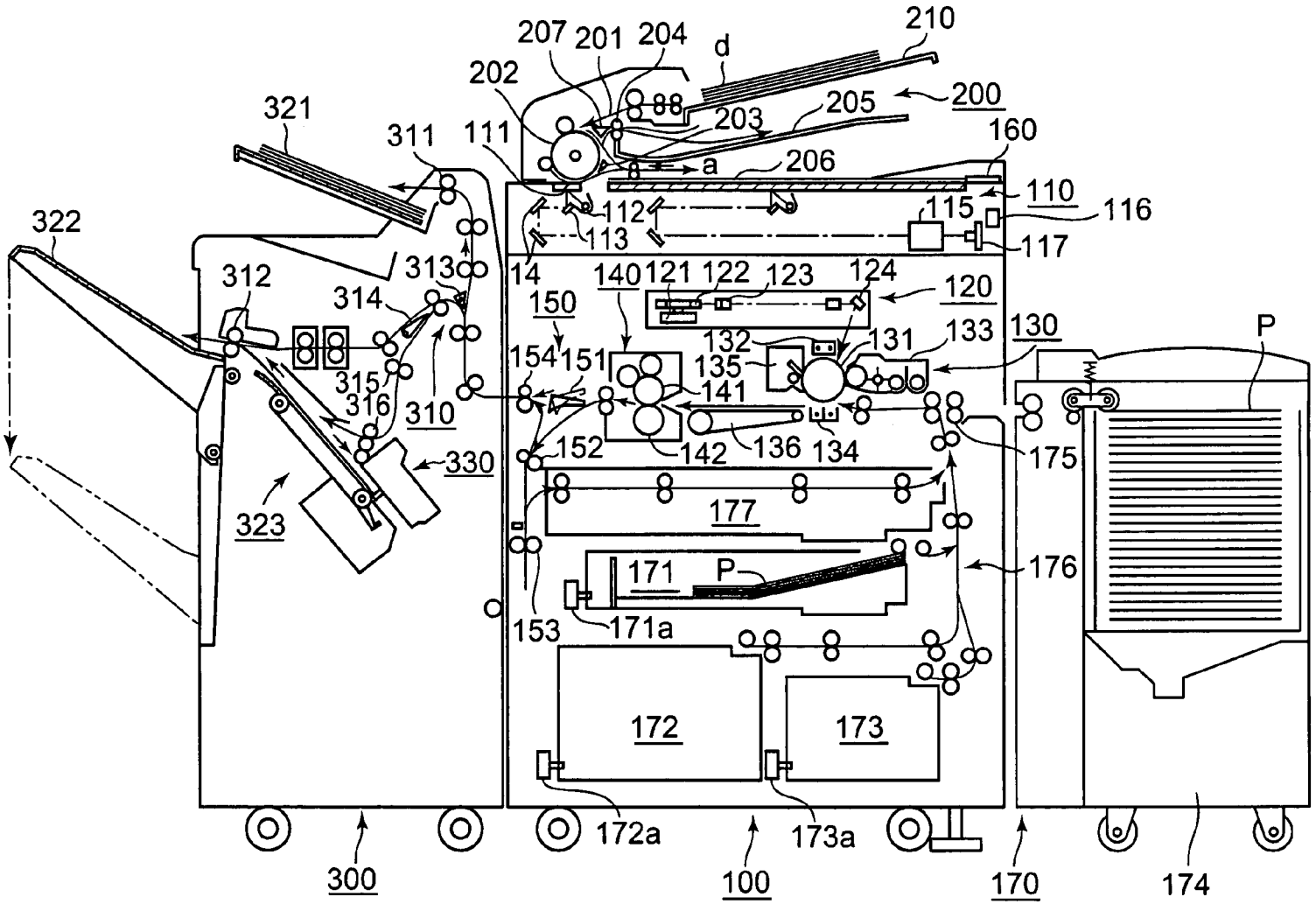
FIG. 1 is a schematic sectional view showing an image printing apparatus of an embodiment according to the present invention.

FIG. 1 is a schematic sectional view showing an image printing apparatus according to an embodiment of the present invention.

An image printing apparatus 1 comprises an image printing apparatus main body 100, and automatic document feeder 200 and post-processing device 300 which serve as peripheral devices connected to the image printing apparatus main body 100.

The automatic document feeder 200 separates one by one document sheets d placed on a document table 210 and feeds the separated document sheet to a document convey path 201. The fed document sheet is wound around a convey drum 202 and conveyed. During convey operation, a document reading unit 110 reads the document image at a document reading position 111 located below the convey drum 202. Upon completion of reading, the document sheet d is exhausted onto a document exhaust table 205 via a first document convey guide 203 having a switching mechanism, and a document exhaust roller 204.

To read a double-sided document sheet d, the document sheet d which has undergone image reading of the first side is fed by the first document convey guide 203 and a reversing roller 206 in a direction indicated by an arrow a. The document sheet temporarily stops while the trailing end of the document sheet is clamped by the reversing roller 206. When the reversing roller 206 starts reverse rotation, the temporarily stopped document sheet d is guided to the first document convey guide 203 and a second document convey guide 207 with a switching mechanism in such a manner that the trailing end of the document sheet d serves as the leading end and the document sheet d is set in a reversed state. The document sheet is then fed out to the document convey path again. The image on the second side of the document sheet is read, and the document sheet d is then exhausted onto the document exhaust table 205 via the first document convey guide 203 and the document exhaust roller 204.

The image printing apparatus main body 100 includes the document reading unit 110, an image writing unit 120, a toner image forming unit 130, a fixing unit 140, a reversing unit 150, an operation display unit 160, and a paper feed unit 170.

The document reading unit 110 irradiates, with an exposure lamp 112 at the document reading position 111, the document surface of the document sheet d conveyed by the automatic document feeder 200. The light reflected by the document surface is focused on the light-receiving surface of an image sensing device 117 via a first mirror unit 113, a second mirror unit 114, and image forming lens 115, thereby reading the document image.

An image signal output from the image sensing device 117 is A/D-converted by an image processor (to be described later) and undergoes processing such as shading correction and compression. The processed image signal is stored as document image information in a storage unit (to be described later).

The image writing unit 120 forms a latent image by scanning the surface of a rotating photosensitive drum 131 with a laser beam in accordance with the image information read out from the memory unit. The image writing unit 120 has a known structure made up of a semiconductor laser 121, polygon mirror 122, cylindrical lens 123, and plane mirror 124.

The toner image forming unit 130 comprises a charging unit 132, developing section 133, transfer/separation section 134, and cleaning section 135, all of which are disposed around the photosensitive drum 131. A latent image is formed by the writing unit 120 on the photosensitive drum 131 whose outer surface is uniformly charged with the charging unit 132. The latent image is then developed by the developing section 133. A toner image is formed on the latent image-bearing outer surface of the photosensitive drum 131. The toner image is transferred by the transfer/separation section 134 onto a paper sheet P conveyed from the paper feed unit 170. The paper sheet P which bears the toner image is fed to the fixing unit 140 by a conveyor belt 136. The residual toner is removed by the cleaning section 135 from the surface of the photosensitive drum 131 from which the toner image has completely been transferred, thereby preparing for the next image printing.

The fixing unit 140 comprises a heating roller 141 and pressure roller 142 which oppose each other. The heating roller 141 and pressure roller 142 heat and press, and convey the paper sheet P fed from the toner image forming unit 130, thereby fixing the toner image on the paper sheet P. Note that the image writing unit 120, toner image forming unit 130, and the fixing unit 140 cooperate to serve as an image printing unit.

The reversing unit 150 feeds out the paper sheet P conveyed from the fixing unit 140, to the post-processing device 300 by using a reversing guide 151 and an exhaust roller 154.

To reverse and feed out the paper sheet P, the reversing guide 151 is switched to guide the paper sheet P below a first reversing roller 152 and second reversing roller 153. The first reversing roller 152 and second reversing roller 153 are reversed to set the trailing end of the paper sheet P as the leading end. The paper sheet P is then fed to the exhaust roller 154.

For image printing on two sides of a paper sheet, i.e., so-called double-sided copying, a paper sheet P which has undergone image fixing on the first side is guided below the reversing guide 151. The second reversing roller 153 clamps the trailing end of the paper sheet P. The paper sheet P is then reversed and fed to a paper re-feed unit 177.

The paper feed unit 170 comprises paper feed trays 171, 172, and 173 which store paper sheets P, a large-capacity paper feed tray 174, a paper feed/convey unit 176 made up of a guide member and a plurality of rollers for picking up the paper sheets P from each of the paper feed trays one by one and conveying the paper sheet P to a paper feed roller 175, the paper feed roller 175, and the paper re-feed unit 177.

The paper feed trays 171, 172, and 173 and large-capacity paper feed tray 174, all of which serve as the paper feed trays, store the paper sheets P. The paper feed/convey unit 176 picks up a paper sheet P from the designated paper feed tray. The paper feed trays 171, 172, and 173 can be opened by pulling them toward the user from the image printing apparatus main body 100. While each paper feed tray is kept open, the paper sheets P are supplied or removed. Tray lock mechanisms 171*a*, 172*a*, and 173*a* are mounted on the paper feed trays 171, 172, and 173 to allow/inhibit to open the paper feed trays 171, 172, and 173, respectively. That is, the tray lock mechanisms 171*a*, 172*a*, and 173*a* serve as the opening/closing inhibition sections which inhibit opening/closing of the paper feed trays 171, 172, and 173.

The paper feed roller 175 corrects skew of a paper sheet P fed from the paper feed/convey unit 176 and feeds out to the toner image formation position of the photosensitive drum 131.

The paper re-feed unit 177 feeds back to the paper feed/convey unit 176 a paper sheet P fed from the reversing unit 150 and supplies the paper sheet P for image printing on the second side.

The operation display unit 160 is a single unit made up of a display section which displays characters and images and an operation section which allows the user to input instructions. The operation display unit 160 comprises a touch panel and pushbuttons. The operation display unit 160 allows the user to perform various settings for the image printing apparatus main body 100, automatic document feeder 200, and post-processing device 300.

The post-processing device 300 serves as an exhaust processing device for stacking paper sheets P exhausted from the image printing apparatus main body 100, and aligning and binding them. In the post-processing device 300, the paper sheet P exhausted from the image printing apparatus main body 100 is clamped and conveyed by a convey roller group 310. The convey path of the paper sheet P is then switched by convey path switching mechanisms 313 and 314. The paper sheet P is then exhausted onto a first exhaust tray 321 via an exhaust roller 311 or onto a second exhaust tray 322 via an exhaust roller 312.

The post-processing device 300 has a function of aligning and binding the paper sheets P exhausted from the image printing apparatus main body 100. The convey path of the paper sheets P is switched by the convey path switching mechanisms 313 and 314. The paper sheets P clamped and conveyed by convey rollers 315 and 316 are stacked and aligned on a processing tray 323. The bundle of stacked paper sheets P is stapled by a stapler 330 and exhausted onto the second exhaust tray 322.

In the second exhaust tray 322, a top surface detection sensor (not shown) detects the top surface of the uppermost paper sheet stacked on the second exhaust tray 322. The height of the second exhaust tray 322 is controlled by a motor (not shown) so that a paper sheet P or a bundle of paper sheets P exhausted via the exhaust roller 312 is stacked onto the top surface of the detected uppermost paper sheet. Note that the post-processing device 300 has two exhaust trays in the embodiments. However, the post-processing device 300 may have one exhaust tray, or three or more exhaust trays.

The tray lock mechanisms 171*a*, 172*a*, and 173*a* serving as the opening/closing sections of the paper feed trays 171, 172, and 173, respectively, will be described with reference to FIG. 2 by exemplifying the tray lock mechanism 171*a* which inhibits/allows opening/closing of the paper feed tray 171.

The tray lock mechanism 171*a* is made up of a lock lever 171*b*, solenoid magnet unit 171*e*, and lock unit 171*f*. The lock lever 171*b* is pivotably provided around a fulcrum 171*d* arranged on a chassis (not shown) of the image printing apparatus main body 100. The solenoid magnet unit 171*e* engages with the lock lever 171*b* through a driving pin 171*c*. The lock unit 171*f* is provided on the paper feed tray 171 and engages with the lock lever 171*b*. An end portion of the lock lever 171*b* forms a ratchet 171*g* to engage with the lock unit 171*f*.

In a normal state, as indicated by solid lines, the lock lever 171*b* is parallel to the wall surface of the paper feed tray 171. At this time, the paper feed tray 171 can be opened/closed.

When the solenoid magnet unit 171*e* is driven and a plunger 171*h* moves in a direction indicated by an arrow X, the lock lever 171*b* pivots about the fulcrum 171*d* in a direction indicated by an arrow Y. As indicated by dotted lines, the ratchet 171*g* of the lock lever 171*b* engages with the lock unit 171*f* of the paper feed tray 171, thereby inhibiting opening/closing of the paper feed tray 171.

Figure 2:
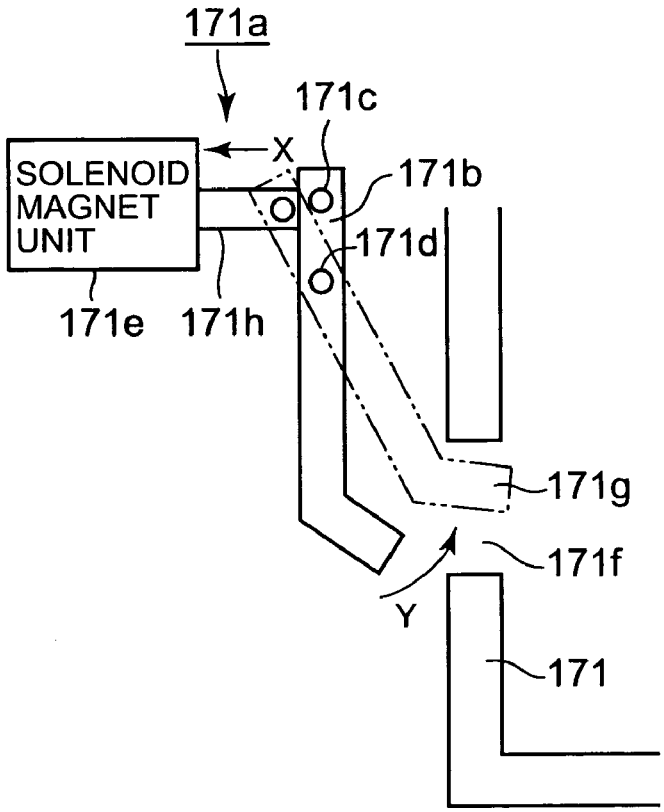
FIG. 2 is a sectional view showing the schematic structure of a tray lock mechanism shown in FIG. 1.

The same mechanisms as the tray lock mechanisms 171*a* shown in FIG. 2 are provided to the paper feed trays 172 and 173 as the tray lock mechanisms 172*a* and 173*a*, respectively.

Figure 3:
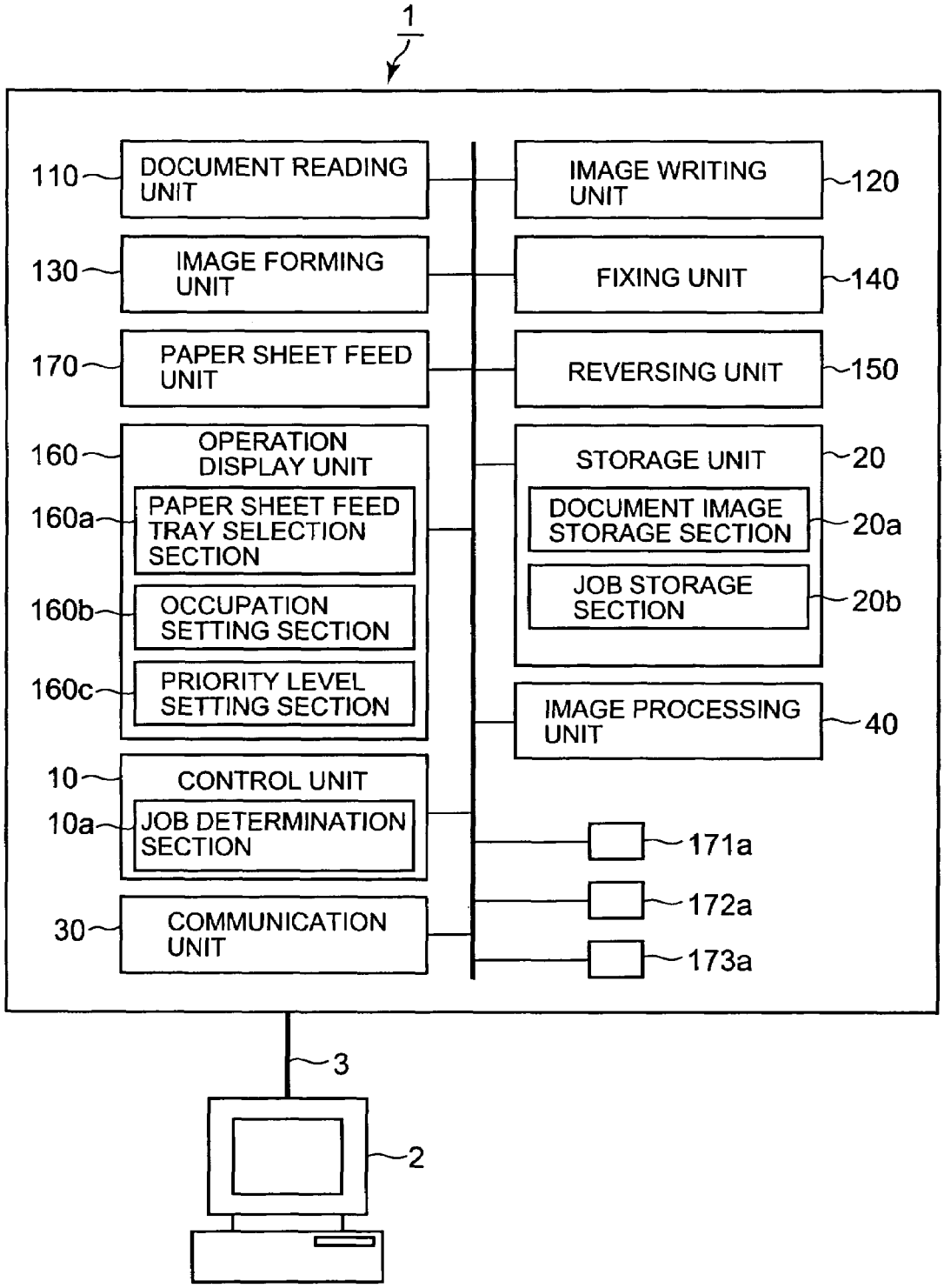
FIG. 3 is a block diagram showing the functional arrangement of the image printing apparatus shown in FIG. 1.

The functional arrangement of the image printing apparatus 1 shown in FIG. 1 will be described with reference to FIG. 3. FIG. 3 is a block diagram showing the functional arrangement of the image printing apparatus 1 shown in FIG. 1.

The image printing apparatus 1 comprises a control unit 10, storage unit 20, communication unit 30, and image processing unit 40 in addition to the portions described with reference to FIG. 1. Note that a description of portions denoted by the same reference numerals as in FIG. 1 will be omitted.

The control unit 10 serving as a control unit is made up of a CPU (Central Processing Unit) (not shown), work memory, and the like. The control unit 10 reads out a program stored in the storage unit 20 to the work memory to perform centralized control of each portion of the image printing apparatus 1 in accordance with the corresponding program.

The control unit 10 also has a function as a job determination section 10*a* which determines a job execution order on the basis of an execution priority level included in a job stored in the storage unit 20 or an occupation setting for a paper feed tray.

The storage unit 20 is made up of a nonvolatile semiconductor memory such as an EEPROM (Electrically Erasable Programmable Read-only Memory), hard disk drive, or the like. The storage unit 20 stores a control program of the control unit 10, font data used by the control unit 10 when generating an image signal or job, various setting information input at the operation display unit 160 and a host computer 2, and the like.

The storage unit 20 has functions as a document image storage section 20*a* and a job storage section 20*b*. The document image storage section 20*a* stores document image information read by the document reading unit 110 shown in FIG. 1. The job storage section 20*b* sequentially stores in an input order a plurality of jobs generated in advance.

Document image information stored in the document image storage section 20*a* is used as image information to be sent to another device connected to a network via the communication unit 30 while a scanner mode is set. While a copy mode to generate a hard copy from a document sheet is set, the document image information is used as image information for generating a hard copy.

The job storage section 20*b* stores a job generated by the control unit 10 on the basis of document image information generated by the document reading unit 110 and processed by the image processing unit 40 and various settings set at the operation display unit 160 while a copy mode is set. The job storage section 20*b* stores a job generated by a control unit (not shown) of the host computer 2 and received by the communication unit 30 via a communication medium 3 while a printer mode is set.

A job refers to a series of control instructions for executing image printing. A job is generated by an information processing device such as the host computer 2 connected via the communication medium 3 or a server (not shown) or the control unit 10 of the image printing apparatus 1 when printing an image by the image printing apparatus 1. Processing or execution for an image printing request is performed for each job. In the present embodiment, a job generated or accepted in advance or stored in the job storage section 20*b* is referred to as a predetermined job, and a job which is to be generated or accepted later than the predetermined job is referred to as a post-determined job.

The communication unit 30 is capable of communication processing with the host computer 2 via the communication medium 3. The communication unit 30 receives, e.g., the various setting information and jobs transmitted from the host computer 2 and notifies the host computer 2 of, e.g., information in the image printing apparatus 1.

The image processing unit 40 performs various processing such as A/D conversion, shading correction, and compression to an image signal output from the sensing device 117. In addition, the image processing unit 40 performs, to a job or document image information read out from the storage unit 20, processing optimum for image printing by the image printing unit.

In the embodiments, the operation display unit 160 has functions as a paper feed tray selection section 160*a*, occupation setting section 160*b*, and priority level setting section 160*c*. The paper feed tray selection section 160*a* selects the paper feed tray, of the paper feed trays 171, 172, 173, and 174, to feed a paper sheet on which an image is printed. The occupation setting section 160*b* sets and occupies the selected paper feed tray. The priority level setting section 160*c* sets the execution priority level of the job stored in the storage unit 20.

Note that each unit shown in FIG. 3 is a block provided to assist understanding of the functions of the image printing apparatus according to the present embodiment, and is not necessarily implemented as a physically independent device or a single device. For example, the function of the control unit 10 may be implemented by a cooperation of CPUs included in the image printing apparatus main body 100 and the post-processing device 300.

First Embodiment

Figure 4:
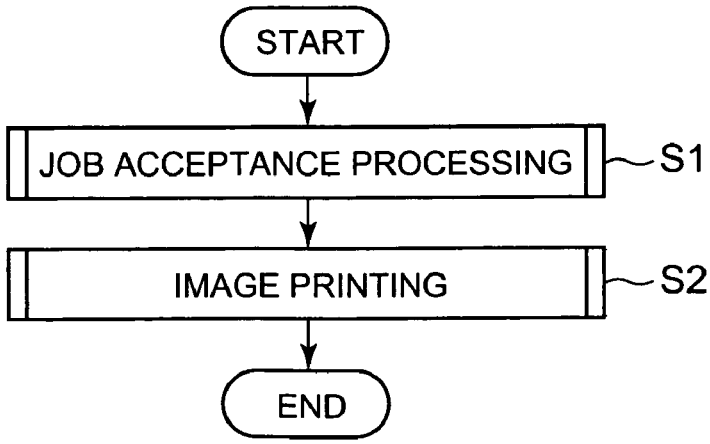
FIG. 4 is a flowchart showing the flow of image printing processing in the image printing apparatus.

The first embodiment of an image printing apparatus according to the present invention will be described. FIG. 4 is a flowchart showing the flow of image printing processing in the image printing apparatus 1 shown in FIGS. 1 and 3. Assume that the image printing apparatus 1 is ON in the flowchart shown in FIG. 4.

In step S1, job acceptance processing is executed. More particularly, a user inputs settings of image printing and post-processing by using an operation display unit 160 or an operation display unit (not shown) of a host computer 2 to generate a job. The generated job is stored in a job storage section 20*b*. When any one of paper feed trays 171, 172, and 173 is set to be occupied, opening/closing inhibiting operation (to be referred to as lock operation hereinafter) of the paper feed tray to be occupied is executed as well.

In step S2, an image is printed on the basis of the job accepted in step S1, thereby terminating the process. More particularly, on the basis of the job generated and stored in step S1, image printing operation and post-processing operation are performed in each portion of the image printing apparatus 1.

Note that in the image printing processing shown in FIG. 4, a process in step S2 is executed after a process in step S1, for descriptive convenience. However, the image printing processing is not limited to this, and the job acceptance processing in step S1 and image printing in step S2 based on a job different from the job to be accepted may be executed simultaneously. Even if the job acceptance processing in step S1 is not executed, while a job unexecuted yet is stored in a job storage section 20*b*, image printing in step S2 is executed on the basis of the stored job.

Figure 5:
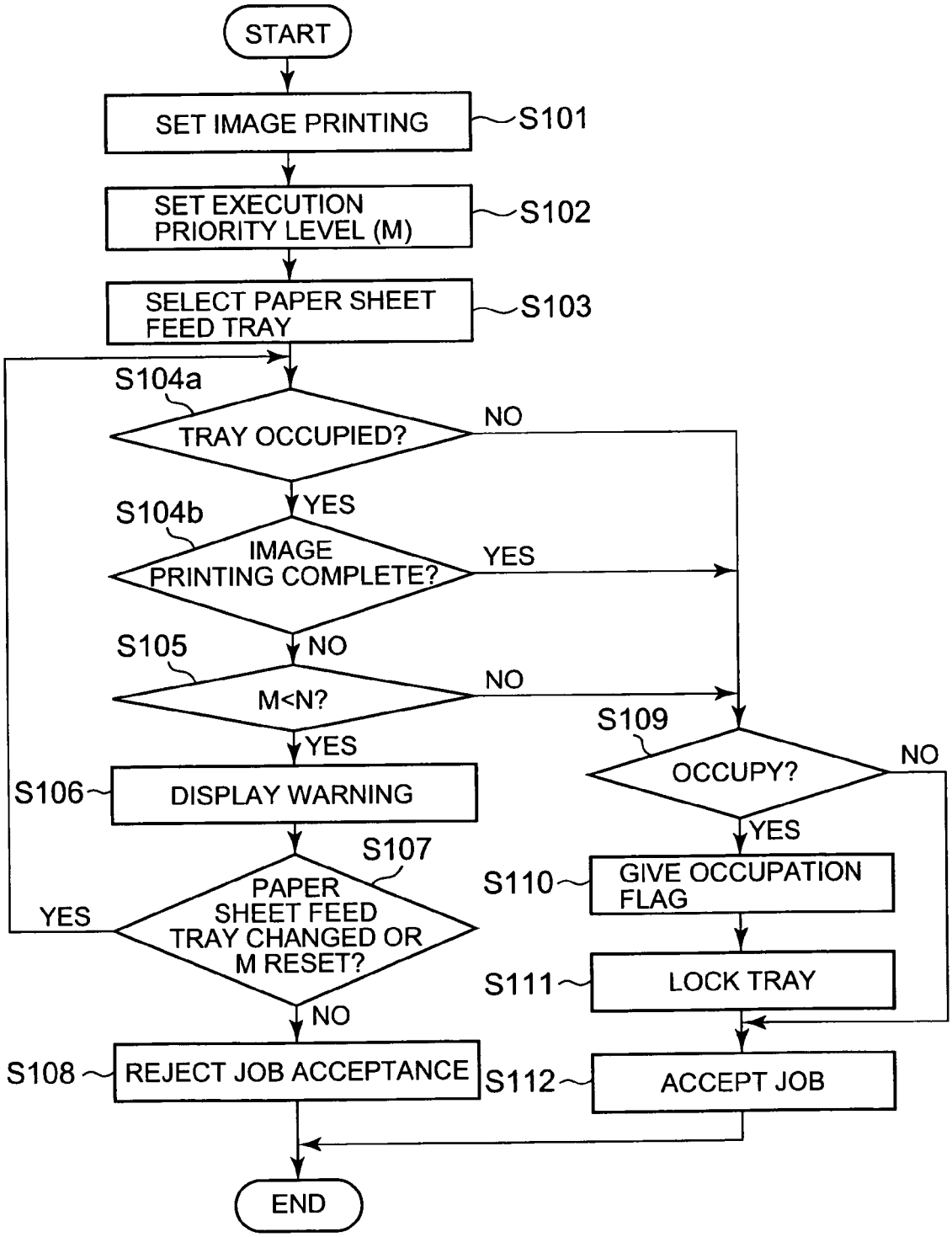
FIG. 5 is a flowchart showing the flow of job acceptance processing shown in FIG. 4 according to the first embodiment.

The job acceptance processing executed in step S1 in FIG. 4 will be described with reference to FIG. 5. FIG. 5 is a flowchart showing the flow of the job acceptance processing executed in step S1 in FIG. 4.

In step S101, the user inputs settings of image printing and post-processing by using the operation display unit 160 or the operation display unit (not shown) of the host computer 2. More particularly, settings include such as a copy count, Nup (contraction/composition processing of N-page images), double-sided image printing, and stapling process.

In step S102, an execution priority level M of the job is set.

Figure 6:
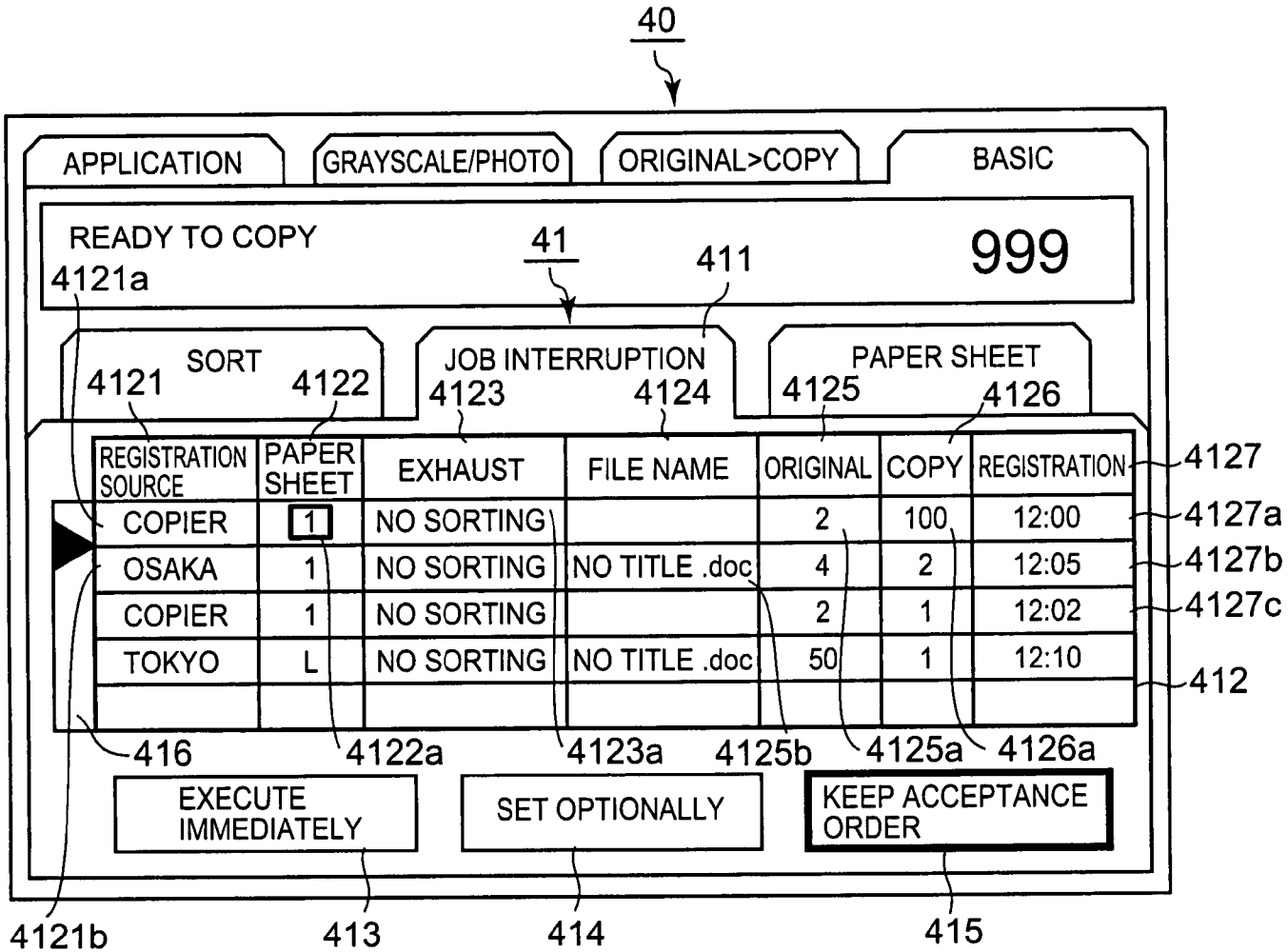
FIG. 6 is a view showing a display example of an execution priority level setting window displayed in the operation display unit of the image printing apparatus.

The execution priority level of the job is set by, e.g., an execution priority level setting unit 41 of a setting window 40 shown in FIG. 6.

A job interrupt tab 411, accepted job list 412, immediate execution button 413, optional setting button 414, acceptance order keeping button 415, and execution priority level changing slider 416 are displayed on the execution priority level setting unit 41. The user can select a desired button by touching the each button via a touch panel.

When the job interrupt tab 411 is selected, display of the setting window 40 in which another setting section such as a sort setting is displayed can be changed to display of the execution priority level setting unit 41 corresponding to the execution priority level setting section 160*c* shown in FIG. 3.

In the accepted job list 412, jobs are displayed in a descending order of the execution priority level from the top. The job to be displayed on the accepted job list 412 is a job which is stored in the job storage section 20*b* and image printing thereof is not started yet. That is, the jobs stored in the job storage section 20*b* are to be sequentially executed from the top of the accepted job list 412. The executed job is deleted from the job storage section 20*b* and disappears from the accepted job list 412.

In the accepted job list 412, for example, a job-registering user 4121 of the job, selected paper feed tray 4122, post-processing setting 4123, file name 4124 of a document or image to be processed in the job, document page count 4125, copy count 4126, and job acceptance time 4127 are displayed for each stored job.

For example, in FIG. 6, a job-registering user 4121*a* of the job which is displayed in the top row of the accepted job list 412 and has the highest priority level is "COPIER", which indicates that the job is a copy mode. A paper feed tray 4122*a* indicates that paper feed tray No. 1 is occupied. A document count 4125*a* is 2, a copy count 4126*a* is 100, and a job acceptance time 4127*a* is 12:00.

In a printer mode, a user name 4121*b* "OSAKA" of the host computer 2 and a document file name 4124*b* are also displayed.

The execution priority level of the job is normally in acceptance order (when the acceptance order keeping button 415 is selected), executing the job of the oldest (earliest) job acceptance time 4127 first. However, when the immediate execution button 413 is selected, the execution priority level of the job becomes the highest and the execution priority level M is set to 0. When the optional setting button 414 is selected, the execution priority level can be optionally set by the execution priority level changing slider 416. For example, a job of job acceptance time 4127*b* with the second execution priority level is newer (later) than a job of job acceptance time 4127*c* with the third execution priority level since the execution priority level of the second execution priority level has been changed from third to second.

That is, in the present embodiment, an execution priority level of a job is an execution order of the job by the image printing apparatus 1, and does not always coincide with the job acceptance order.

Referring back to FIG. 5, a paper feed tray to be used in the job is selected in step S103.

Figure 7:
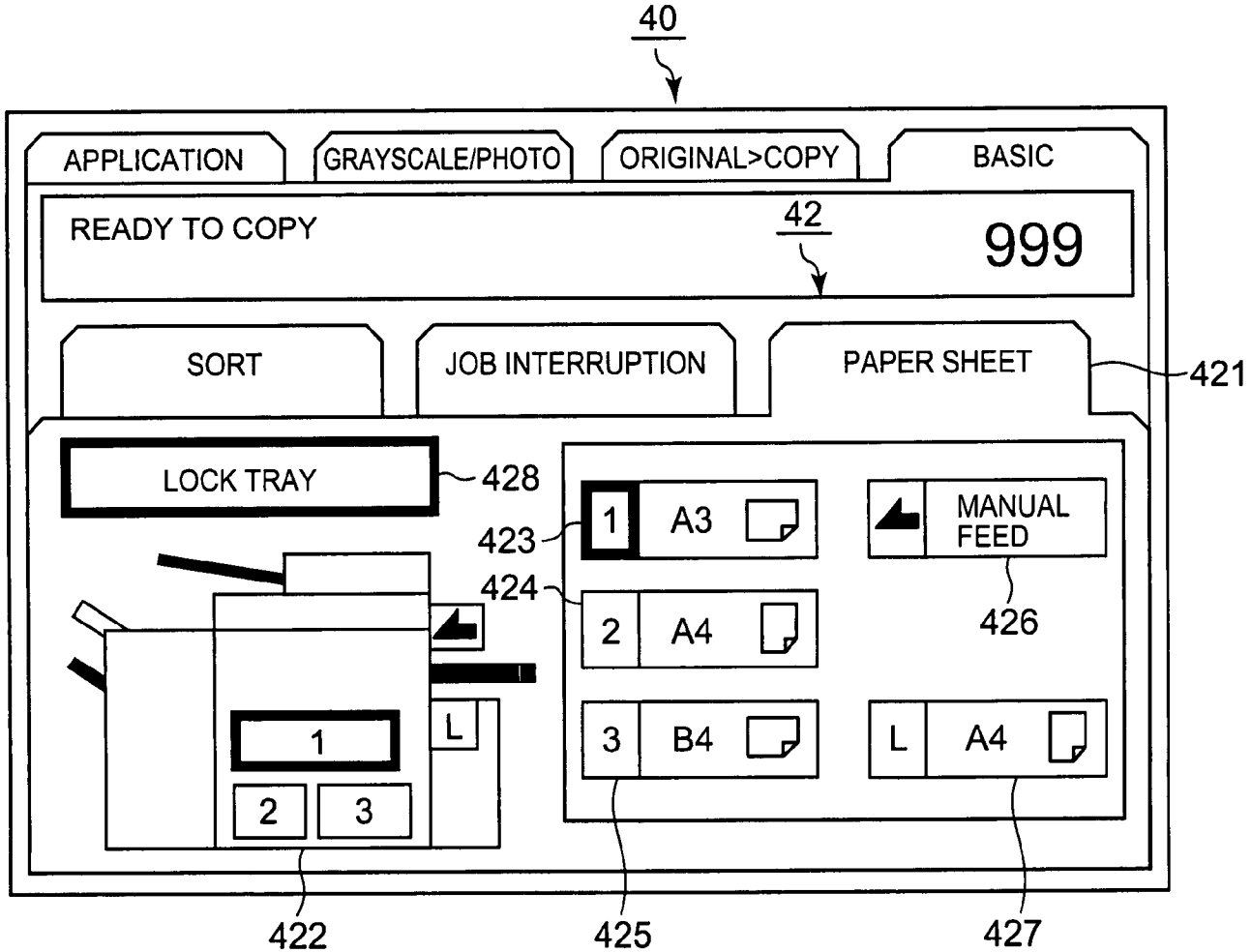
FIG. 7 is a view showing a display example of a paper feed tray selection window displayed in the operation display unit of the image printing apparatus.

A paper feed tray is selected in a paper feed tray selection unit 42 which is displayed when a paper selection tab 421 of the setting window 40 shown in FIG. 7 is selected.

Paper feed tray selection buttons 423, 424, 425, 426, and 427 correspond to the paper feed tray selection section 160*a* shown in FIG. 3. Each of the paper feed tray selection button 423, 424, 425, 426, and 427 has a number or sign corresponding to an icon 422 and indicating which paper feed tray in the image printing apparatus 1 is to be selected by the button. The size of the paper sheet stored in the paper feed tray to be selected is also given to the paper feed tray selection button. The paper feed tray is selected by selecting one of the paper feed tray selection buttons 423, 424, 425, 426, and 427.

Assume that an occupation button 428 corresponding to the occupation setting section 160*b* shown in FIG. 3 is selected. In this case, the selected paper feed tray can be set not to be selected in another post-determined job accepted after the predetermined job unless, e.g., the paper feed tray is changed to another paper feed tray, or the execution priority level of the post-determined job is set to be lower than that of the predetermined job. That is, the selected paper feed tray is set to be occupied.

Referring back to FIG. 5, in step S104*a*, whether the paper feed tray selected in step S103 has already been set to be occupied for another job is determined. That is, whether the paper feed tray set to be occupied for a predetermined job stored in the job storage section 20*b* prior to the post-determined job is the same as that selected in step S103 and the predetermined job has already been stored in the job storage section is determined. When the paper feed tray has already been set to be occupied (step S104*a*; YES), a process in step S104*b* is executed. Otherwise (step S104*a*; NO), a process in step S109 is executed.

In step S104*b*, whether image printing based on the predetermined job is complete is determined. If image printing based on the predetermined job is not complete yet (step S104*b*; NO), a process in step S105 is executed. Otherwise, a process in step S109 is executed.

In step S105, it is determined whether the execution priority level M set in step S102 is higher than the execution priority level N set for the predetermined job which occupies the paper feed tray selected in step S103. That is, whether the execution priority level M set for the post-determined job is higher (higher in level) than the execution priority level N set for the predetermined job is determined. When the execution priority level M is higher than the execution priority level N ($M<N$ in mathematical expression) (step S105; YES), a process in step S106 is executed. When the execution priority level M is not higher than the execution priority level N ($M \geqq N$ in mathematical expression) (step S105; NO), the process in step S109 is executed.

In step S106, a warning display indicating that the job is not acceptable is displayed on the operation display unit 160 or the display unit of the host computer 2. The display prompts the user to change the paper feed tray to another paper feed tray or set the execution priority level of the post-determined job lower than that of the predetermined job.

In step S107, it is determined whether the paper feed tray selection has been changed or the execution priority level of the post-determined job has been changed. If changed (step S107; YES), the flow returns to step S104. Otherwise (step S107; NO), an error or the like is displayed and acceptance of the post-determined job is rejected (step S108), thereby terminating the process.

In step S109, it is determined whether the paper feed tray selected in step S103 is set to be occupied, that is, whether the occupation button 428 is selected in the paper feed tray selection unit 42 shown in FIG. 7. If the paper feed tray is to be occupied (step S109; YES), a process in step S110 is executed. Otherwise (step S109; NO), a process in step S112 is executed.

In step S110, an occupation flag for the paper feed tray selected in step S103 is given to the post-determined job.

In step S111, the tray lock mechanism 171*a*, 172*a*, or 173*a* corresponding to the paper feed tray 171, 172, or 173 selected in step S103 is operated to inhibit opening/closing of the paper feed tray. Note that after opening/closing of the paper feed tray is inhibited, even the user who has set the post-determined job cannot open/close the paper feed tray. A display which prompts the user to set a paper sheet in the paper feed tray is preferably displayed before the tray lock mechanism is operated.

In step S112, a job as a series of control instructions to print the image is generated. The generated job is stored in the job storage section 20*b*, thereby terminating the process.

Figure 8:
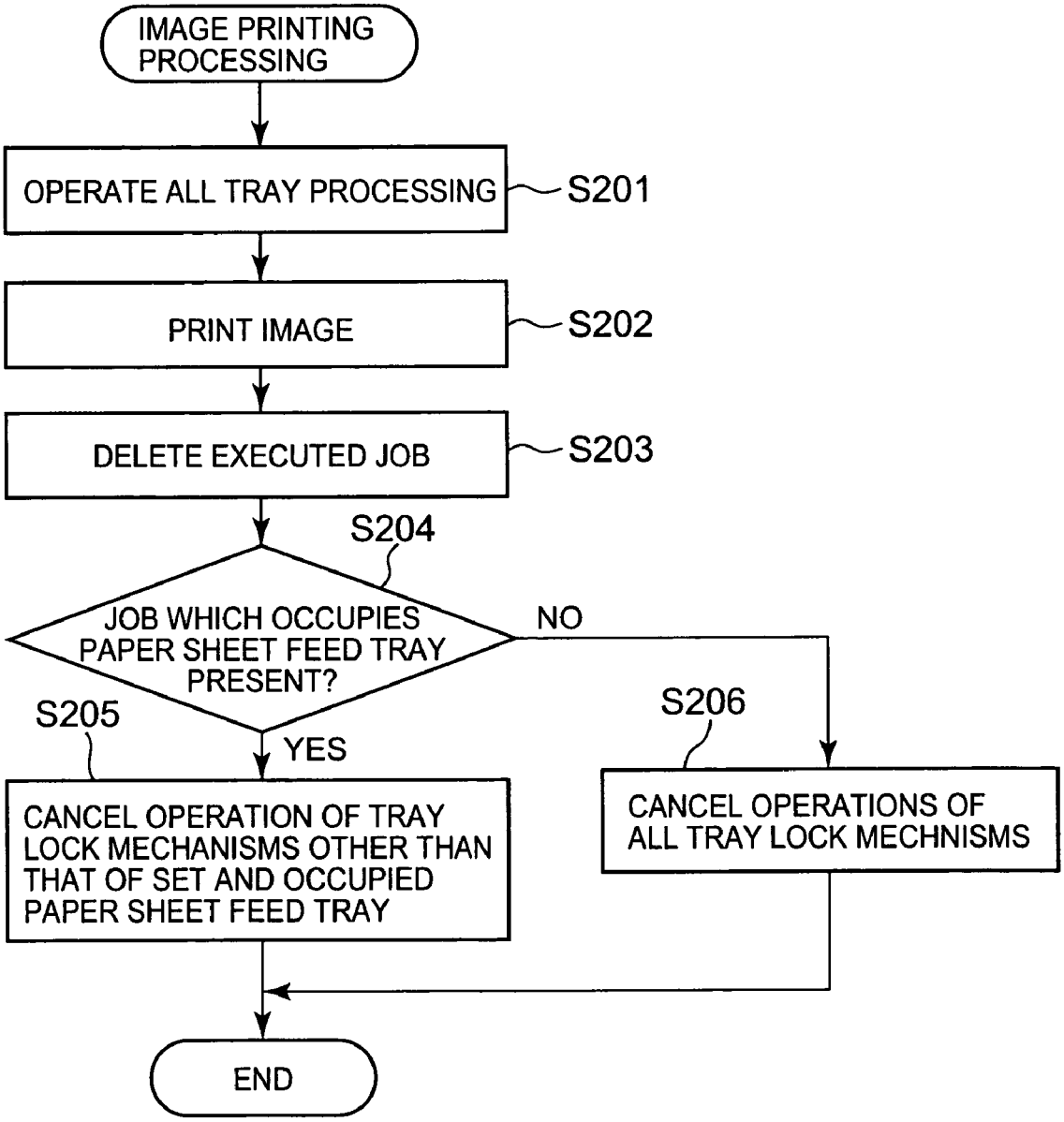
FIG. 8 is a flowchart showing the flow of image printing processing shown in FIG. 4.

Image printing executed in step S2 in FIG. 4 will be described with reference to FIG. 8. FIG. 8 is a flowchart showing the flow of image printing processing performed in step S2 in FIG. 4. Note that the flowchart shown in FIG. 8 shows a process to execute one job while another job which is different from the current image printing job and is not executed yet is stored in the job storage section 20*b*.

In step S201, the tray lock mechanisms 171*a*, 172*a*, and 173*a* and a tray lock mechanism (not shown) of the paper feed tray 174 are operated to inhibit openings/closings of all the paper feed trays 171, 172, 173, and 174. This prevents unloading of the paper feed tray during the image printing unit is operating, thereby preventing the paper sheet P during convey operation from conveyance failure caused by opening/closing operation of the paper feed tray.

In step S202, the image is printed on the paper sheet P by the image printing unit of the image printing apparatus main body 100, and then a post-processing is performed by the post-processing device 300.

In step S203, the job executed in step S202 is deleted from the job storage section 20*b*.

In step S204, a job determination section 10*a* shown in FIG. 3 determines whether any job given the occupation flag of the paper feed tray, i.e., any job set to occupy the paper feed tray, is being stored in the job storage section 20*b*. When a job set for occupying the tray is being stored in the job storage section 20*b* (step S204; YES), a process in step S205 is executed. Otherwise (step S204; NO), a process in step S206 is executed.

In step S205, the operation of the tray lock mechanisms other than that of the paper feed tray which is subjected to set to be occupied for the job determined to have occupation setting in step S204 is canceled, thereby terminating the process.

In step S206, the operations of all the tray lock mechanisms are canceled, thereby terminating the process.

The operations of the tray lock mechanisms 171*a*, 172*a*, and 173*a* interlocked with image printing in the process shown in FIG. 8 will be described with reference to FIG. 9.

Figure 9:
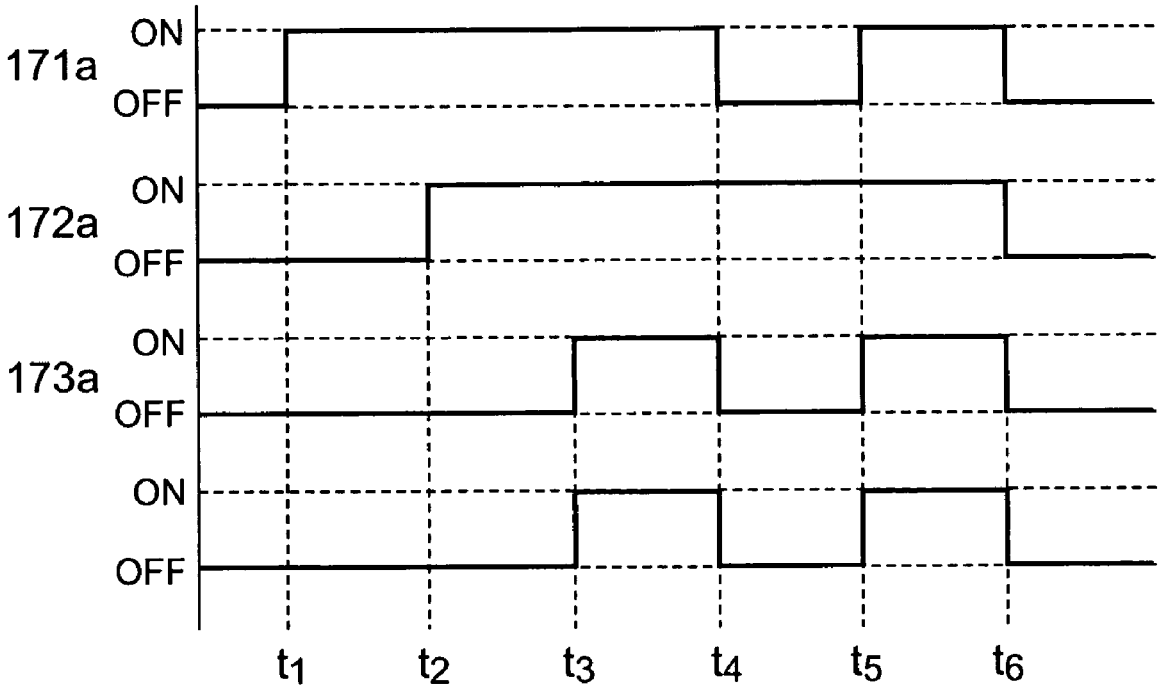
FIG. 9 is a timing chart showing the operation of the tray lock mechanism shown in FIG. 1.

FIG. 9 is a timing chart showing the operation of the tray lock mechanisms 171*a*, 172*a*, and 173*a* and the image printing unit of the image printing apparatus main body 100. In all components, ON indicates an operating state and OFF indicates a stopped state. The timing chart shown in FIG. 9 shows a case in which the second job which occupies the paper feed tray 172 is accepted after the first job which occupies the paper feed tray 171 and an image is printed on the basis of the job.

In acceptance processing of the first job, when the paper feed tray 171 is set to be occupied, that is, when the occupation button 428 shown in FIG. 7 is selected ($t_1$), the tray lock mechanism 171*a* is operated to inhibit opening/closing of the paper feed tray 171.

Subsequently, in acceptance processing of the second job, when the paper feed tray 172 is set to be occupied ($t_2$), the tray lock mechanism 172*a* is operated to inhibit opening/closing of the paper feed tray 172.

As shown in step S201 in FIG. 8, when the image printing based on the first job is started ($t_3$), all the tray lock mechanisms are operated. In this embodiment, however, since the tray lock mechanisms 171*a* and 172*a* are already ON, only the tray lock mechanism 173*a* is operated.

As shown in step S205 in FIG. 8, when the image printing based on the first job is complete ($t_4$), the first job is deleted from the job storage section 20*b*. Since no job which sets to occupy the paper feed tray 171 is stored in the job storage section 20*b* now, the operation of the tray lock mechanism 171*a* of the paper feed tray 171 whose occupation is canceled is canceled in addition to the tray lock mechanism 173*a* of the paper feed tray 173 which has not been occupied. Since the second job which sets to occupy the paper feed tray 172 is still stored in the job storage section 20*b*, the operation of the tray lock mechanism 172*a* is not canceled.

When image printing based on the second job is started ($t_5$), the tray lock mechanisms 171*a* and 173*a* are operated.

When the image printing based on the second job is complete ($t_6$), no job which sets to occupy the paper feed tray is stored in the job storage section 20*b*. Therefore, the operations of the tray lock mechanisms 171*a*, 172*a*, and 173*a* are canceled.

As has been understood from the above description, assume that a post-determined job as an interrupt job or priority level-changed job is set before or during execution of image printing processing by the predetermined job generated in advance and stored in the job storage section 20*b*. In this time, in case of keeping the following conditions satisfied, storage of the post-determined job in the job storage section 20 is inhibited.

(A) A tray set to be occupied for the predetermined job stored in the job storage section prior to the post-determined job is the same as that selected for the post-determined job.

(B) The execution priority level set for the post-determined job is higher than that set for the predetermined job.

(C) Image printing based on the predetermined job is not complete yet.

As described above, according to this embodiment, when the execution priority level set for the post-determined job is lower than that set for the predetermined job, the post-determined job is accepted and stored in the job storage section even if the tray set to be occupied for the predetermined job is the same as that selected by the post-determined job. The preferential use right for the tray desired in the predetermined job is ensured, and at the same time working efficiency of the post-determined job and the use efficiency of the paper feed tray can be improved.

According to this embodiment, when the execution priority level set for the post-determined job is higher than that set for the predetermined job, the post-determined job is not accepted. Therefore, the preferential use right for the paper feed tray desired in the predetermined job can be ensured.

According to this embodiment, while image printing based on the predetermined job is ended immediately upon storage of the predetermined job in the job storage section, opening/closing of the paper feed tray set to be occupied for the predetermined job is inhibited by the opening/closing inhibition section. A paper sheet placed on the occupied tray is not replaced with another paper sheet, after the predetermined job is stored in the job storage section, by a user except the user who has set the predetermined job. Therefore, the preferential use right for the paper feed tray desired in the predetermined job can be ensured.

Furthermore, according to this embodiment, opening/closing of the paper feed tray is inhibited by the tray lock mechanism after the job whose paper feed tray is set to be occupied is accepted by the image printing apparatus. Therefore, neither the paper feed tray is opened by another user nor the desired paper sheet is replaced with another one. The preferential use right for the paper feed tray desired in the predetermined job can be ensured without increasing the size of the apparatus.

Second Embodiment

The second embodiment will be described with reference to a flowchart shown in FIG. 10.

Figure 10:
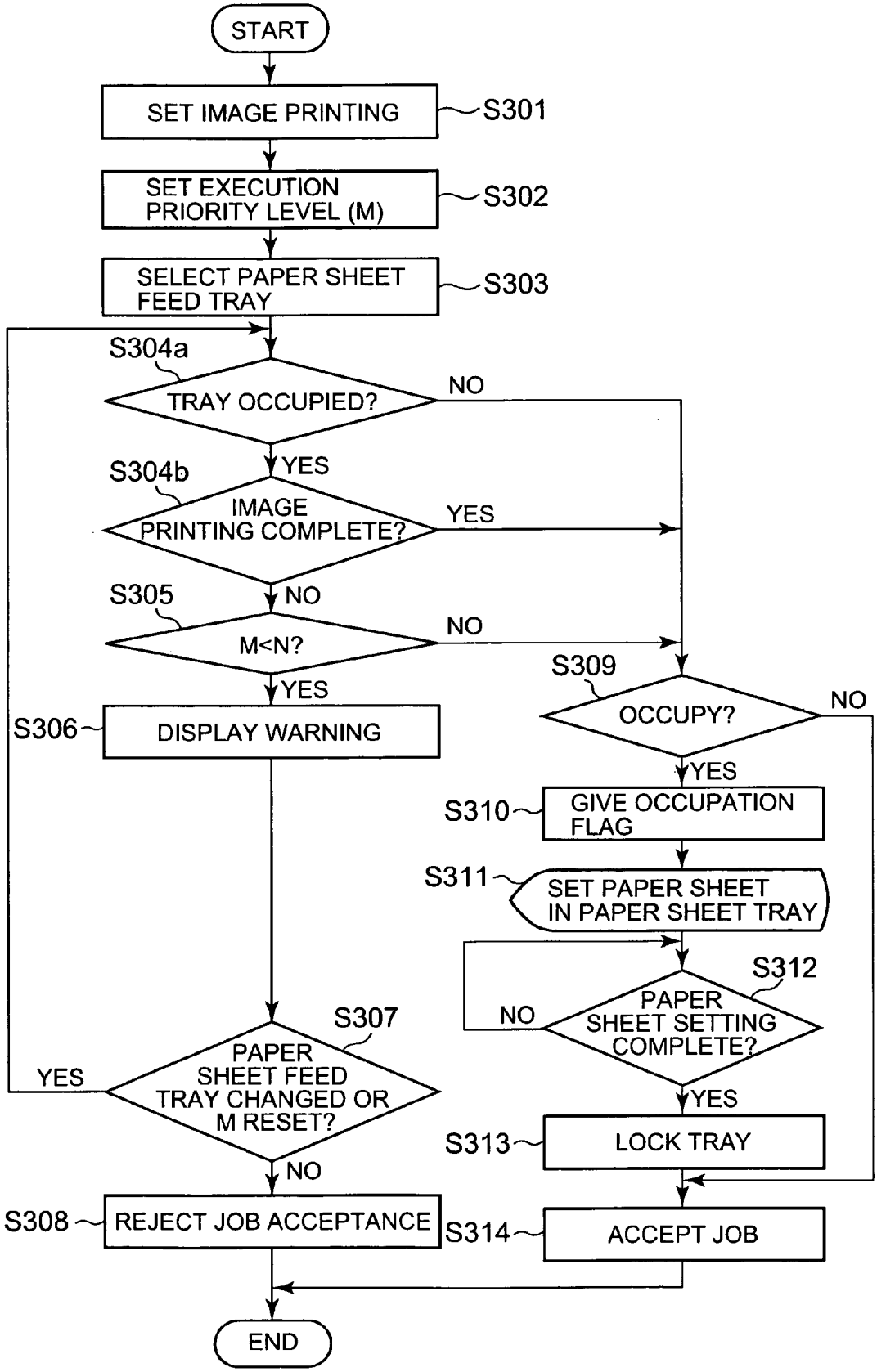
FIG. 10 is a flowchart showing the flow of job acceptance processing shown in FIG. 4 according to the second embodiment.

FIG. 10 shows a modification of the job acceptance processing executed in step S1 in FIG. 4. As shown in FIG. 10, steps S301 to S310 in the second embodiment are the same as steps S101 to S110 in the first embodiment shown in FIG. 5. In the second embodiment, processes executed in steps different from those in the first embodiment, i.e., processes executed in steps S311 to S313 will be described.

In step S311, a message which prompts a user to set a desired paper sheet in a paper feed tray selected in step S303 is displayed on an operation display unit 160 or a display unit (not shown) of a host computer 2. After opening/closing of the paper feed tray is inhibited, even the user who has set the job cannot open the paper feed tray. The above process prevents the user from forgetting to set the desired paper sheet.

In step S312, whether a paper sheet setting in the paper feed tray is complete is determined. The completion of the paper sheet setting is determined by, e.g., displaying an OK button on a window displayed in step S311 and detecting the selection of the OK button. An opening/closing detection sensor (not shown) provided in each of the paper feed tray 171, 172, and 173 may detect that the paper feed tray selected in step S303 is unloaded and reset.

In step S313, of tray lock mechanisms 171*a*, 172*a*, and 173*a*, the tray lock mechanism which locks the paper feed tray selected in step S303 is operated to inhibit opening/closing of the paper feed tray.

In step S314, a job as a series of control instructions to print an image is generated. The generated job is stored in a job storage section 20*b*, thereby terminating the process.

As has been described above, according to this embodiment, opening/closing of the paper feed tray is inhibited by the tray lock mechanism after the job whose paper feed tray is set to be occupied is accepted by the image printing apparatus. Therefore, neither the paper feed tray is opened by another user nor the desired paper sheet is replaced with another one. The preferential use right for the paper feed tray desired in the predetermined job can be ensured without increasing the size of the apparatus.

According to this embodiment, when the execution priority level M set for the post-determined job is higher than the execution priority level N set for the predetermined job (M<N in mathematical expression), the post-determined job is not accepted. Therefore, the preferential use right for the paper feed tray desired in the predetermined job can be ensured.

Third Embodiment

According to the control of the first and second embodiments described above, when a paper feed tray is set to be occupied for a predetermined job and the paper feed tray set to be occupied for the predetermined job is the same as that selected for a post-determined job, whether to accept the predetermined job is determined, and in case of keeping the above described predetermined conditions satisfied, the acceptance of the post-determined job is not allowed. The third embodiment employs the configuration in which acceptance of a post-determined job is allowed without determining whether a paper feed tray set to be occupied for a predetermined job is the same as that selected for the post-determined job. The third embodiment may employ the configuration in which acceptance of a post-determined job is allowed even when a paper feed tray set to be occupied for the predetermined job is the same as that selected for a post-determined job although the execution priority level M of the post-determined job is set lower than the execution priority level N of the predetermined job.

This prevents, when a paper feed tray is set to be occupied for a predetermined job, a post-determined job which selects the same tray as that already set and occupied from being executed prior to the predetermined job, or prevents the post-determined job from interrupting the predetermined job during the predetermined job is executed. Therefore, the preferential use right for the paper feed tray desired in the predetermined job can be ensured, and at the same time re-acceptance of the post-determined job can be suppressed and the working efficiency can be improved.

In this case, priority level can be set by a priority level setting section 160*c*.

Note that in the embodiments, the image printing apparatus in which the post-processing device 300 is attached to the electrophotographic image printing apparatus main body 100 is exemplified as an image printing apparatus. However, the present invention can be applied to a single image printing apparatus, image printing apparatus of another image printing mode, and the like.

The foregoing advantages of the present invention are realized even by supplying a storage medium storing a software program for realizing the functions of the above-described embodiments to a system or an apparatus, and causing the computer (CPU or MPU) of the system or the apparatus to read out and execute the program stored in the storage medium.

In this case, the program read out from the storage medium implements the functions of the above-described embodiments by itself, and the program and the storage medium storing the program constitute the present invention.

As a storage medium for supplying the program, a floppy (registered trademark) disk, a hard disk, an optical disk, a magnetooptical disk, a CD-ROM, a CD-R, a magnetic tape, a nonvolatile memory card, a ROM, or the like can be used.

The functions of the above-described embodiments are implemented not only when the readout program are executed by the computer but also when the OS (Operating System) running on the computer performs part or all of actual processing on the basis of the instructions of the program.

The functions of the above-described embodiments are also implemented when the program read out from the storage medium are written in the memory of a function expansion board inserted into the computer or a function expansion unit connected to the computer, and the CPU of the function expansion board or function expansion unit performs part or all of actual processing on the basis of the instructions of the program.

The detail arrangement and detail operation of each component which constitutes the image printing apparatus according to the present invention can be appropriately changed without departing from the spirit or scope of the invention.

According to the image printing apparatus of the embodiments, assume the tray selected for a forthcoming post-determined job is the same as that set to be occupied for the predetermined job stored in the job storage section prior to the forthcoming post-determined job. In this case, only when the execution priority level set for the post-determined job is lower than that set for the predetermined job, storage of the post-determined job in the job storage section is allowed. The preferential use right for the tray desired in the predetermined job is ensured, and at the same time the working efficiency of the post-determined job can be improved.

Also, in the embodiments, before or during image printing based on the predetermined job, an interrupt is performed by a job higher in priority level than the predetermined job to suppress the use of a printing medium in the occupied tray. Therefore, the preferential use right for the tray desired in the predetermined job can be ensured.

According to the embodiments, in case of keeping the conditions (A) and (B) satisfied, storage of the corresponding job in the job storage section is inhibited. When the execution priority level set for a post-determined job is set higher than that set for the predetermined job, the post-determined job is not accepted. Therefore, the preferential use right for the tray desired in the predetermined job can be ensured.

According to the image printing apparatus of the embodiments, in case of keeping the conditions (A), (B), and (C) satisfied, a job is inhibited from being stored in the printing medium storage section in the tray set to be occupied for the job. Even if the tray set to be occupied for the predetermined job is the same as that selected by the post-determined job, storage of the post-determined job in the storage section is designed to be allowed upon completion of image printing based on the predetermined job. The preferential use right for the tray desired in the predetermined job is ensured, and at the same time working efficiency of the post-determined job can be improved.

According to the image printing apparatus of the embodiments, when the tray set to be occupied for the predetermined job is the same as that selected by the post-determined job, the job execution priority level of the post-determined job is set lower than that of the predetermined job. The preferential use right for the tray desired in the predetermined job is ensured, and at the same time the working efficiency of the post-determined job can be improved.

According to the image printing apparatus of the embodiments, while image printing based on the predetermined job is ended immediately upon storage of the predetermined job in the job storage section, opening/closing of the tray set to be occupied for the predetermined job is inhibited by the opening/closing inhibition section. After the predetermined job is stored in the job storage section, the printing medium placed on the occupied tray is not replaced with another printing medium by a user except the user who has set the predetermined job. The preferential use right for the tray desired in the predetermined job can be ensured.

According to the image printing apparatus of the embodiments, while image printing based on the job whose tray is set to be occupied is ended after this job is stored in the job storage section, opening/closing of the occupied tray is inhibited by the opening/closing inhibition section. After the job is accepted by the image printing apparatus, neither the tray is opened by another user nor the desired printing medium is replaced with another one. The preferential use right for the tray desired in the predetermined job can be ensured without increasing the size of the apparatus.

What is claimed is:

1. An image printing apparatus for job based printing of an image on a printing medium, comprising:

a plurality of trays on which printing media are placeable;

a job storage section which sequentially stores a plurality of jobs;

a tray selection section which selects a tray on which a printing medium subjected to image printing based on a forthcoming post-determined job is placeable;

an occupation setting section which sets the tray selected by said tray selection section as occupied;

a priority level setting section which sets execution priority levels of the jobs stored in said job storage section; and a control unit which determines whether the post-determined job is allowed to be stored in said job storage section, wherein when a tray set to be occupied for a predetermined job stored in said job storage section prior to the post-determined job is the same as that selected for the post-determined job, said control unit allows the post-determined job to be stored in said job storage section only if the execution priority level set for the post-determined job is lower than that set for the predetermined job.

2. An apparatus according to claim 1, wherein if the following conditions (A) and (B) are satisfied, then said control unit inhibits to store the post-determined job in said job storage section:

(A) the tray set to be occupied for the predetermined job stored in said job storage section prior to the post-determined job is the same as that selected for the post-determined job; and (B) the execution priority level set for the post-determined job is higher than that set for the predetermined job.

3. An apparatus according to claim 1, wherein if the following conditions (A), (B), and (C) are satisfied, then said control unit inhibits to store the post-determined job in said job storage section:

(A) the tray set to be occupied for the predetermined job stored in said job storage section prior to the post-determined job is the same as that selected for the post-determined job;

(B) the execution priority level set for the post-determined job is higher than that set for the predetermined job; and (C) image printing based on the predetermined job has not been completed.

4. An apparatus according to claim 1, further comprising an opening and closing inhibition section which inhibits opening and closing of said tray occupied for the predetermined job, wherein from immediately after storage of the predetermined job in the job storage section until image printing based on the predetermined job is complete, said control unit makes said opening and closing inhibition section inhibit opening of said occupied tray.

5. An image printing apparatus for job based printing of an image on a printing medium, comprising:

a plurality of trays on which printing media are placeable;

a job storage section which sequentially stores a plurality of jobs;

a tray selection section which selects a tray on which a printing medium subjected to image printing based on a forthcoming post-determined job is placeable;

an occupation setting section which sets the tray selected by said tray selection section as occupied;

a priority level setting section which sets execution priority levels of the jobs stored in said job storage section; and a control unit which determines whether the post-determined job is allowed to be stored in said job storage section, wherein when a tray set to be occupied for a predetermined job stored in said job storage section prior to the post-determined job is the same as that selected for the post-determined job and when image printing based on the predetermined job has not been completed, said control unit allows the post-determined job to be stored in said job storage section only if the execution priority level set for the post-determined job is lower than that set for the predetermined job.

6. An apparatus according to claim 5, wherein if the following conditions (A) and (B) are satisfied, then said control unit inhibits to store the post-determined job in said job storage section:

(A) the tray set to be occupied for the predetermined job stored in said job storage section prior to the post-determined job is the same as that selected for the post-determined job; and (B) the execution priority level set for the post-determined job is higher than that set for the predetermined job.

7. An apparatus according to claim 5, wherein if the following conditions (A), (B), and (C) are satisfied, then said control unit inhibits to store the post-determined job in said job storage section:

(A) the tray set to be occupied for the predetermined job stored in said job storage section prior to the post-determined job is the same as that selected for the post-determined job;

(B) the execution priority level set for the post-determined job is higher than that set for the predetermined job; and (C) image printing based on the predetermined job has not been completed.

8. An apparatus according to claim 5, further comprising an opening and closing inhibition section which inhibits opening and closing of said tray occupied for the predetermined job, wherein from immediately after storage of the predetermined job in the job storage section until image printing based on the predetermined job is complete, said control unit makes said opening and closing inhibition section inhibit opening of said occupied tray.

9. An image printing apparatus for job based printing of an image on a printing medium, comprising:

a plurality of trays on which printing media are placeable;

a job storage section which sequentially stores a plurality of jobs;

a tray selection section which selects a tray on which a printing medium subjected to image printing based on a forthcoming post-determined job is placeable;

an occupation setting section which sets the tray selected by said tray selection section as occupied; and a priority level setting section which sets execution priority levels of the jobs stored in said job storage section, wherein when a tray set to be occupied for a predetermined job stored in said job storage section prior to the post-determined job is the same as that selected for the post-determined job, said priority level setting section sets the execution priority level of the post-determined job lower than that set for the predetermined job.

10. An apparatus according to claim 9, further comprising an opening and closing inhibition section which inhibits opening and closing of said tray occupied for the predetermined job, wherein from immediately after storage of the predetermined job in the job storage section until image printing based on the predetermined job is complete, said control unit makes said opening and closing inhibition section inhibit opening of said occupied tray.

* * * * *